US005134789A

United States Patent [19]

Godau et al.

[11] Patent Number: 5,134,789

[45] Date of Patent: Aug. 4, 1992

[54] INSTALLATION FOR WET AND/OR DRY TREATMENT OF A WEB, YARN, STRAND OR OF FILIFORM TEXTILE GOODS

[76] Inventors: Eckhardt Godau, Via Collina 9, CH-6962 Lugano-Viganello; Gottlieb Benz, Birkenweg 4, CH-8890 Flums, both of Switzerland

[21] Appl. No.: 491,686

[22] Filed: Mar. 12, 1990

[30] Foreign Application Priority Data

Mar. 13, 1989 [DE] Fed. Rep. of Germany ..... 3908167

[51] Int. Cl.[5] ..... F26B 19/00

[52] U.S. Cl. ..... 34/61; 34/153; 34/148; 34/155

[58] Field of Search ..... 34/60, 61, 62, 17, 18, 34/19, 90, 236, 209, 210, 211, 212, 213, 214, 215, 216, 217, 218, 153, 12, 148, 155

[56] References Cited

U.S. PATENT DOCUMENTS

| | | | |
|---|---|---|---|
| 1,627,529 | 5/1927 | Wigglesworth | 34/212 X |
| 2,319,812 | 5/1943 | Gram | 34/153 |
| 3,581,406 | 6/1971 | Lucke | 34/153 |

*Primary Examiner*—Henry A. Bennet
*Attorney, Agent, or Firm*—Herbert Dubno

[57] ABSTRACT

The invention relates to an installation for the wet and-/or dry treatment, such as washing, dyeing, bleaching, steaming, drying, finishing and/or sizing of a web, yarn, strand or filiform textile goods with a carrier supporting the textile goods, consisting of several rollers, on which the textile goods are guided as an endlessly running band and with at least one or several treatment unit(s), wherein the carrier with the textile goods can travel in any desired succession. The dimensions of the rollers basically correspond to the ones of rollers in industrial installations, but can be reduced when the installation has to operate under lab-test conditions. Compared to industrial installations, this installation has an extremely compact construction.

22 Claims, 8 Drawing Sheets

35
33
34
35
37
36
19
16
31
15
30
20
29
32
3
21
11
28
4
17
10
12
18
13
1
5
5
2
8
6
9
31
29
38
28
L

INSTALLATION FOR WET AND/OR DRY TREATMENT OF A WEB, YARN, STRAND OR OF FILIFORM TEXTILE GOODS

FIELD OF THE INVENTION

The invention relates to an installation for the wet or dry treatment, e.g. washing, dyeing, bleaching, steaming, drying, finishing and/or sizing of web, yarn, strand or filiform textile goods, with at least one treatment unit and with a carrier for the support of the textile goods.

THE RELATED ART

Textile goods such as webs, yarn, strands or filiform materials are subjected to many wet treatments, but also to dry treatments, such as thermosetting and thermal brine treatment and thermal developing. For their production, expensive machinery and installations with sizable dimensions have to be made available. However, before production starts, tests on a smaller scale have to be performed, in order to establish whether the desired results can be achieved with the planned process and materials. Such tests can not be run on the scale of the industrial installation primarily due to their high cost, and for this reason laboratories are used, which basically recreate on a considerably reduced scale the construction of the industrial installation. Installations of the mentioned kind usually have a length of up to 120 m. However, when these installations are recreated as a model on a smaller scale, certain conditions result which do not correspond to the realities of production. As a result of their considerably reduced dimensions, these laboratory facilities furnish results as to treatment times, temperatures, physical forces (shearing forces during washing) which most times differ from the results of the industrial installations.

Also, there is an increasing demand on the market for cuts of materials with full width for the production of entire garments. Presently, these cuts (2–4 m) are produced mostly in large-scale installations or compact installations ( reduced large-scale installations). Generally, in order to be able to dye such cuts on one of the above continuous installations, "minimal-length" pieces (200–600 m) have to be available. This way, undesired lengths of material are produced and installations built for industrial-scale production are unproductively used during the so-called "sampling" process.

Large-scale continuous installations are usually single key-in machines which cost between about 300,000 and 3,000,000 dollars. To start them several times a year (at least two times, often even four times) for the sampling results in considerable economic strain and at the same time disturbs the normal production process.

In the last years, the trend towards more frequent and short-term fashion changes has increased. The so-called "designer fashion", i.e. of garments provided with a visible "trademark" (label) is also spreading. The need of one or more collections for presentation (for instance for the stores) requires the availability of cuts of material in various colors.

It is therefore the object of the invention to create an installation of the kind mentioned in the introduction, which can recreate the conditions of large-scale installations also for the production of short lengths of material, e.g. cuts or lab samples, so that the performed dyeing of lab samples or cuts corresponds to the results to be expected in the industrial process.

According to the invention, this problem is solved due to the steps which are the subject of the characterization part of patent claim 1. Advantageous developments result from the dependent claims.

As a result of the teaching of the invention, it is possible to achieve dimensions, treatment times, technological and technical process parameters, as well as process developments similar to the ones of the large-scale installations, which in spite of that can be accommodated in a very limited space. On continuous large-scale installations, various processes can be carried out, through successively arranged units, e.g. foulard impregnating, steam developer, washing machine, dryer, etc., which "refine" the textile product. In the installation of the invention, such individual units are also used, with the advantage that the process sequence can be changed at will, or the same process can be carried out successively several times The programmable support for the material carries the material to the treatment units , whereby the succession and the number of treatment can also be preprogrammed, which is not possible in the fixed large-scale installations. The material support, on which the textile goods revolve in the manner of an endless belt is preprogrammed to move from treatment stage to treatment stage. At the same time the material support has also the function of a squeezing mechanism, which takes care to squeeze out the excess liquor after each treatment stage. Due to the above arrangement, continuous processes are carried out "digitally-continuously".

For a batter understanding of the invention, the following treatments are mentioned, which among others can be carried out on an installation according to the invention:

1. Preliminary treatment of a cotton fabric

| | |
|---|---|
| prewashing in a washing tank | (2x) |
| enzyme impregnation in the impregnation tank | (1x) |
| desizing in the steamer | (1x) |
| washing in the washing tank | (3x) |
| peroxide impregnation in the impregnation tank | (1x) |
| bleaching in the steamer | (1x) |
| drying in the blast-dryer | (1x) |

2. Dyeing of a prebleached polyester-cotton blend:

| | |
|---|---|
| impregnation with dispersion dye in the impregnation tank | (1x) |
| predrying in the infrared dryer | (1x) |
| drying in the hot-flue | (1x) |
| thermal brine treatment in the hot-flue | (1x) |
| intermediate cleaning in the wash tank | (2x) |
| drying in the hot-air blower | (1x) |
| impregnation with sulfur dyes in the impregnation tank | (1x) |
| fixing in the steamer | (1x) |
| rinsing in the washing tank | (2x) |
| oxidizing in the wash tank | (1x) |
| brightening with soap in the wash tank | (1x) |
| washing in the wash tank | (3x) |
| drying in the blast dryer | (1x) |

3. Indigo-dyeing of a cotton warp in three "slivers"

| | |
|---|---|
| prewashing in the washing tank | (2x) |
| immersion in the indigo-dye bath | (1x) |
| oxidizing in the air passage | (1x) |
| immersion in the indigo-dye bath | (1x) |
| oxidizing in the air passage | (1x) |
| washing in the washing tank | (3x) |

-continued

| | |
|---|---|
| drying in the blast dryer | (1x) |

4. Finishing of a pregassed denim fabric

| | |
|---|---|
| prewashing in the washing bath | (3x) |
| finishing with softeners in the impregnation bath | (1x) |
| drying in the blast dryer | (1x) |

In all four of these treatment types the turning speed of the good, the treatment times of the individual process stages, the condition of the liquor, concentrations, squeezing pressure, residual wetness and so on are compared with the large-scale installation, in order to obtain a comparable result.

The reproducibility for similar treatments is insured due to the electronic, freely-programmable control and the automatic control of the process parameters.

The practitioner (textile chemist) can establish the programs without special previous knowledge; no limits are set to his tendency to research and find new developments, which means that the invention is also especially applicable to "Research and Development". The technology as well as the sequence of stages and the treatment times can be modified at will, so that large-scale continuous installations can be imitated, independently of the composition of their individual units. The practitioner faced with new investments can establish the sequence of the units and their dimensions correspondingly to the demand of the market.

Last, but not least, the reduction of the effects on the environment have also to be mentioned, since the invention limits itself to the use of minimal amounts.

BRIEF DESCRIPTION OF THE DRAWING

Further aims, features, details and advantages of the invention result from the following description of embodiments with the aid of the attached drawing. It shows.

DETAILED DESCRIPTION

Figure 1:
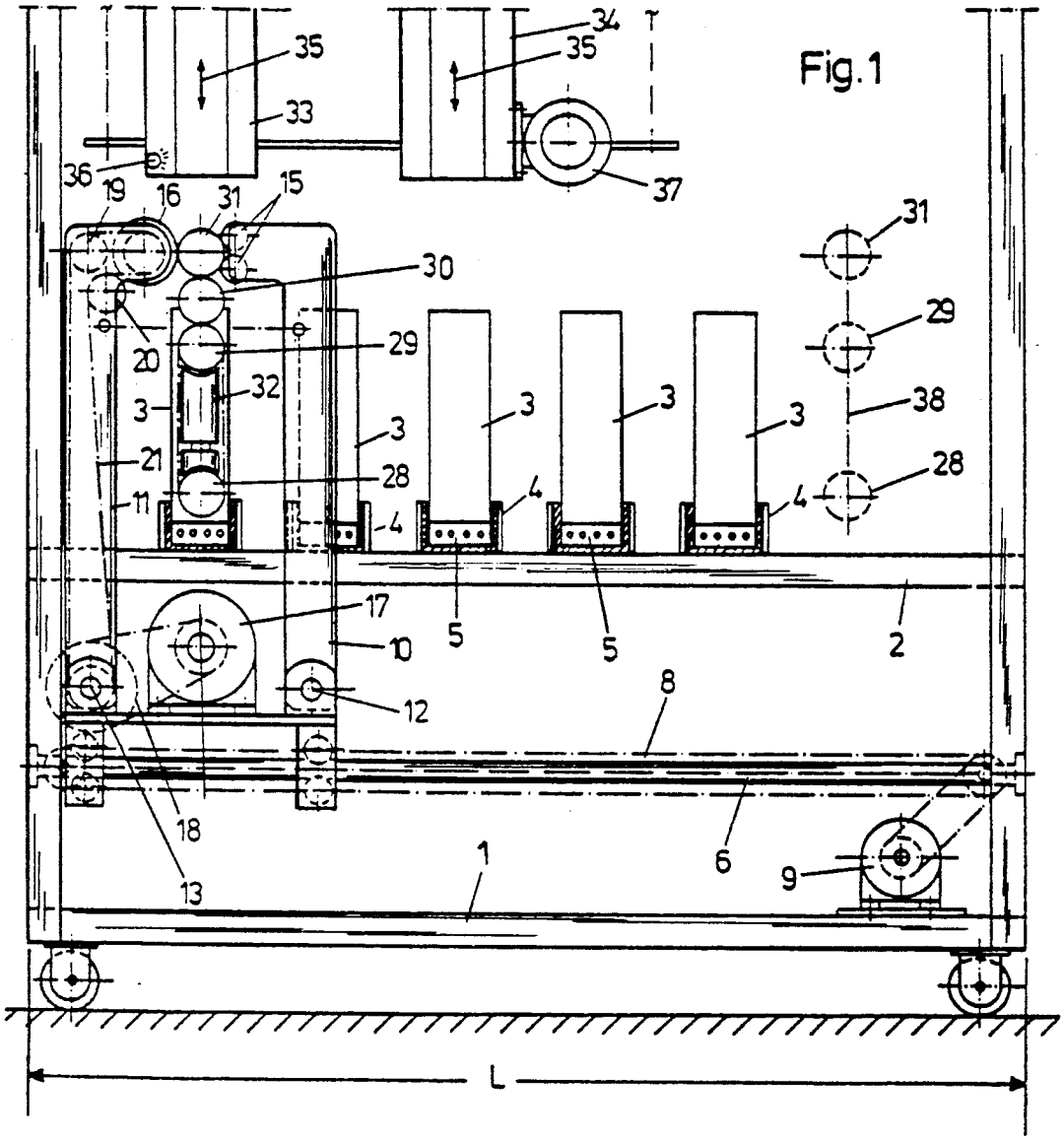
FIG. 1 a schematic longitudinal section of an embodiment of an installation for the process cycle of the invention with stepping unit.

In a machine frame 1, on a horizontal bearing surface 2 several treatment vats 3 are arranged at equal distance from each other. These treatment vats are received in holders 4, which can also be provided with a heating device 5, in order to heat the liquid contained in vat 3, if necessary. Below the bearing surface 2, a pair of horizontal tracks 6 is arranged and a horizontal frame 7, drivable by a program-controlled stepping motor 9 via a chain pull 8, can be moved on these tracks.

Figure 3:
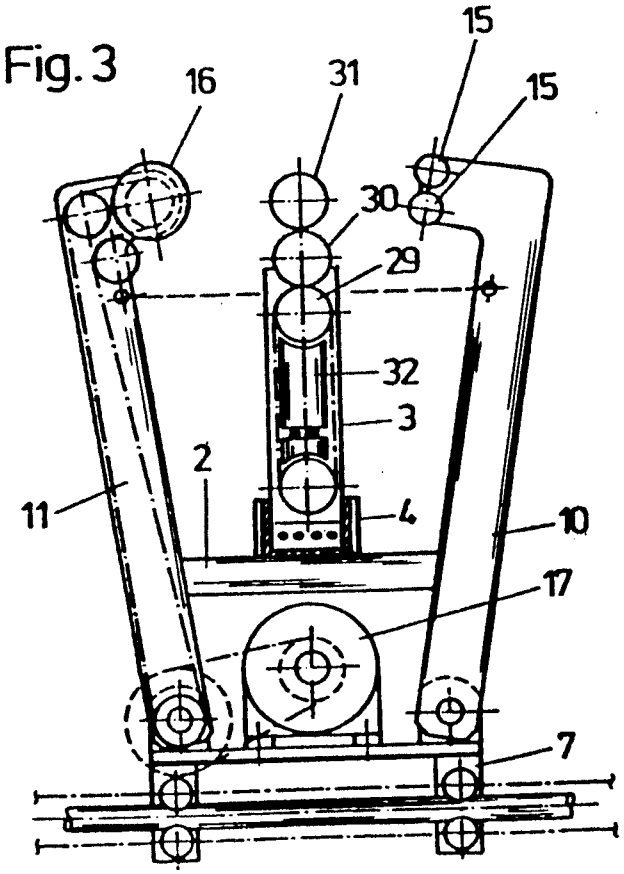
FIG. 3 a schematic representation of the installation of the invention in another phase of the process, such as for instance the opening of the squeezing mechanism with subsequent raising of the material support.
Figure 2:
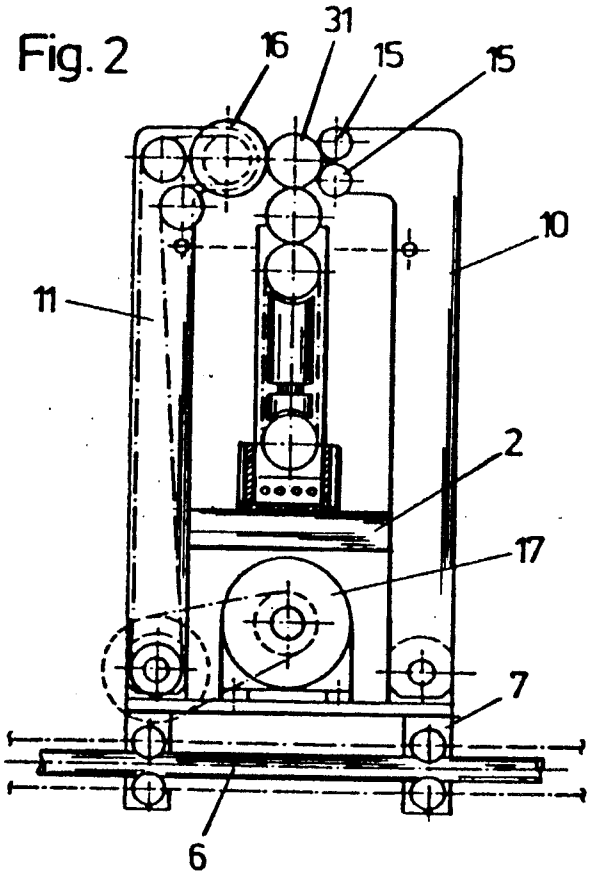
FIG. 2 a schematic representation of the essential part of an installation according to the invention in a certain stage of the process, e.g. dyeing stage or the wetting stage, or the rinsing stage, or the application of chemicals, etc.

On this frame 7, swivel arms 10 and 11 are arranged in pairs and at a distance from each other. In the representations of FIGS. 1, 2 and 3, the swivel axes 12 and 13 of the swivel arms 10 and 11 are perpendicular to the plane of the drawing. Between these two swivel arms 10 and 11, a piston-cylinder unit is provided, which in FIG. 1 is indicated only by a broken line, and by means of which the swivel arms can be swung within the drawing plane (FIG. 1 and FIG. 3). The swivel arm 10 carries at its upper end three support rollers 15; the other swivel arm 11 carries a squeezing roller 16, which can be driven by means of a motor 17 affixed to the frame 7, via guide rollers 18, 19, 20 as well as via chain 21. The squeezing roller 16 can also be designed as a "floating roller", as it is usually done in many squeezing mechanisms.

Figure 5:
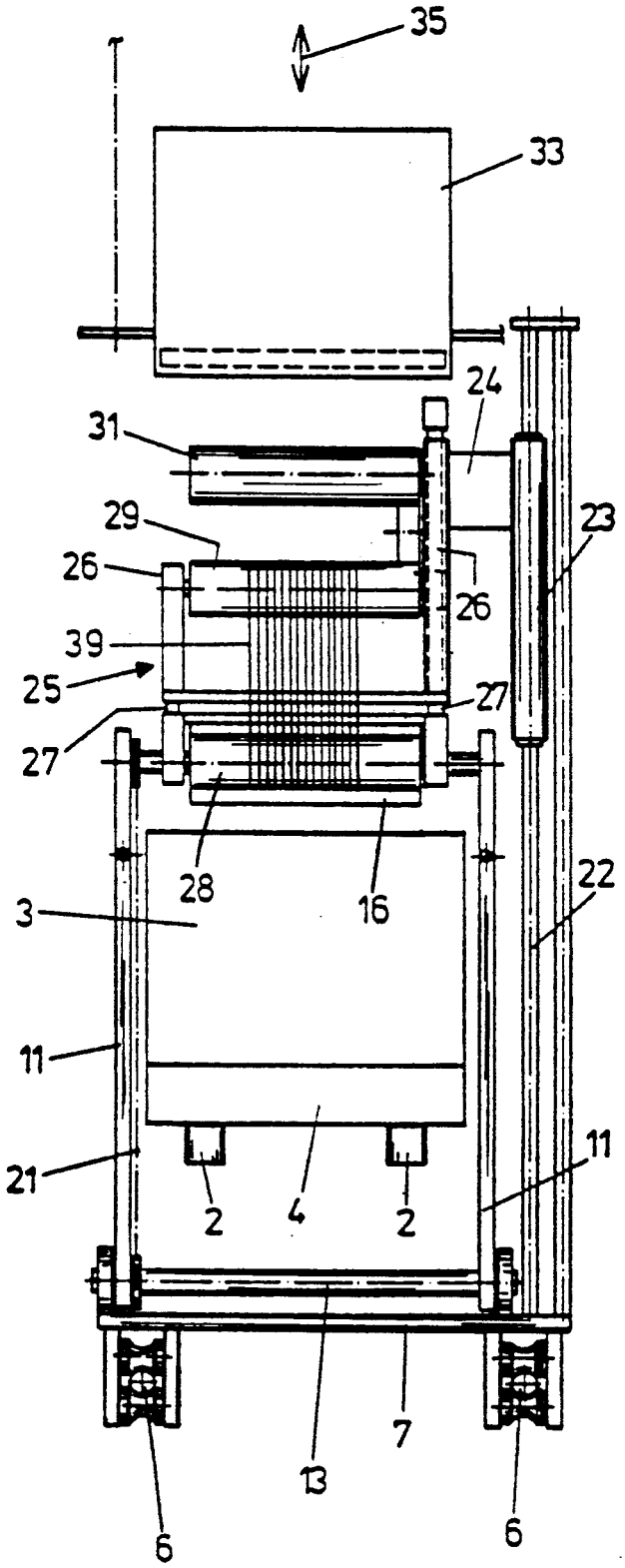
FIG. 5 a schematic cross section of an embodiment with raised material support, for instance the air passage.
Figure 6:
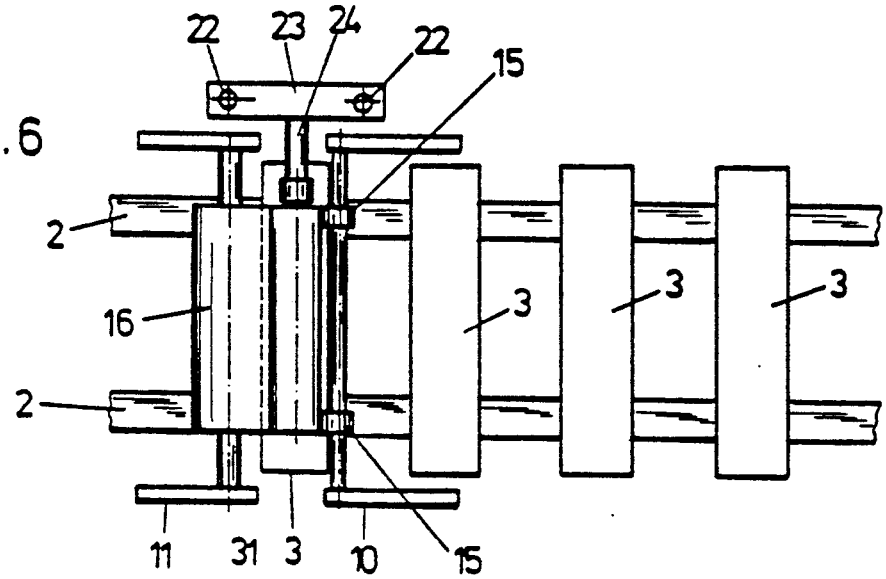
FIG. 6 a top view of the installation according to FIG. 2.

On the frame 7 a vertical guide 22 is arranged, which in FIG. 1 would be located behind the drawing plane and which is not shown in this figure, for the sake of the overview. This guide 22 is illustrated in FIGS. 5 and 6. Due to this vertical guide 22, a support 23 is slidably supported , suitably over a program-controlled stepping motor which is not shown here, and this support 23 carries a vertical frame 25 via a bracket 24. The vertical frame sides of frame 25 are telescopic and each has an external part 26 and an internal part 27. Now the rollers 28 and 29 are rotatably supported on these parts of the frame sides. These rollers can also be supported in a fixed manner and a control tension roller can be mounted instead of the displacement body. The drive takes place via a friction wheel 30 or via a chain.

In the upper part of the machine frame 1 (FIG. 1) two box-like chambers 33 and 34 which can be raised and lowered are provided, respectively aligned with one of the treatment vats 3. In the one chamber 33 a steaming device 36 is located, and in the other chamber 34 a warm-air blower 37 with infrared rods for drying is located.

In the following, a segment of the operation in the installation is described in detail, without specific reference to a certain treatment stage or a certain treatment process.

The textile goods to be treated are placed on the rollers 28 and 29, as an endless band. The rollers 28 and 29 form the support for the textile material, i.e. the material carrier. Then, the material carrier is raised by means of the support 23 along the vertical guides 22 (FIG. 5), whereby the swivel arms 10 and 11 diverge. Now, the horizontal frame 7 runs to the left according to the programmed step sequence, until the material carrier reaches a position above the vat 3. At this point, the support 23 is lowered, the material carrier is dipped in the vat 3 (FIG. 3), the swivel arms 10 and 11 are brought together by the piston-cylinder unit 14 and the motor 17 actuates the pressure roller 16 and thereby also the roller 29, via roller 31 and the friction wheel 30, so that now the textile material is endlessly turned in the treatment vat 3.

Figure 4:
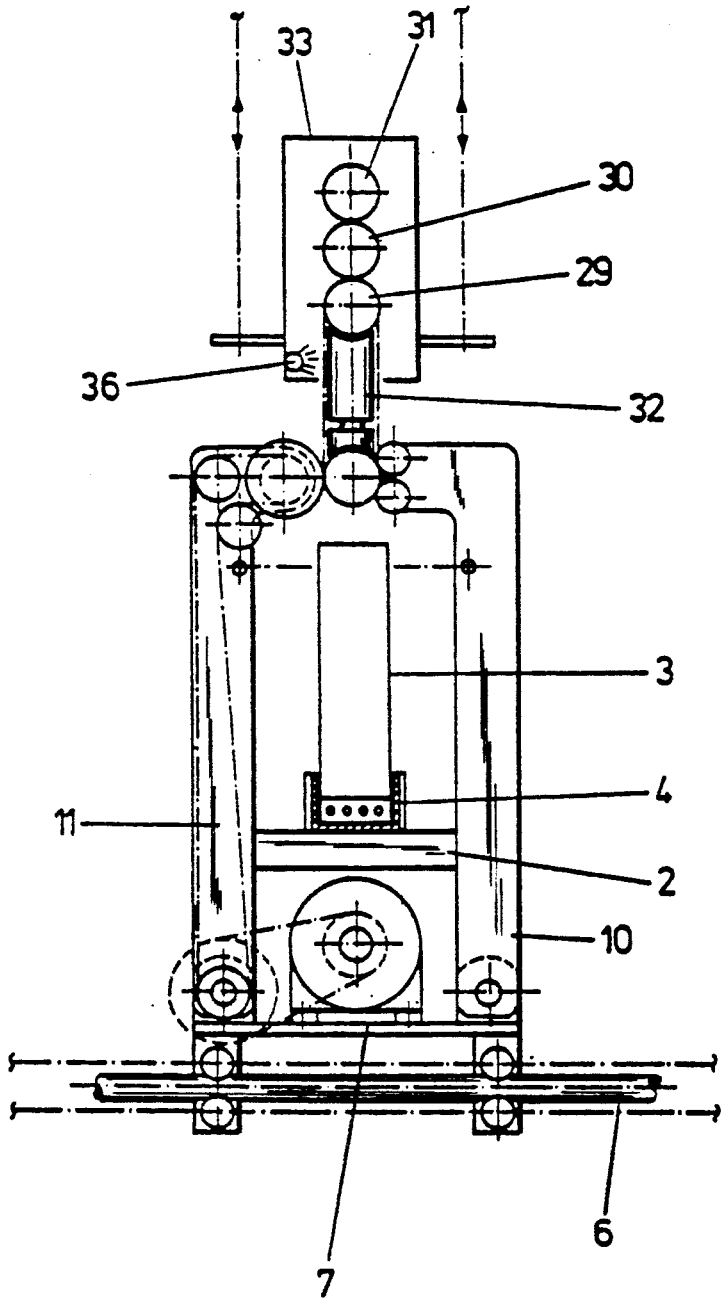
FIG. 4 a schematic representation of the installation of the invention in a further phase of the process, such as for instance the steaming sequence.

When the dwelling time established for the textile material has passed, the swivel arms 10 and 11 are brought back to their open position (FIG. 3) by reactuation of the piston-cylinder unit 14, after which the material carrier with the rollers 28, 29 and the roller 31 can be raised over the support 23. Thereby, the support 23 is raised until the lower roller 28 of the material carrier is at the same height level with the pressure roller 16, whereafter the swivel arms 10 and 11 are again brought to their closed position (FIG. 4). In this position of the installation components, (FIG. 4), the residual liquid can be squeezed out from the textile material by the pressure roller 16 and the carrier roller 28, which here takes over the function of a back-pressure roller. The squeezed liquid runs back into the vat 3. After the squeezing process, the above-mentioned treatment can either be repeated, or the carriage continues to travel according to the preprogrammed step sequence to the next treatment vat, in order to continue there the dipping and squeezing process.

If the program includes also steaming, the chamber 33 is preheated with steam. For the steaming stage, the chamber 33 descends over the material support containing the revolving textile goods. If the goods have to be dried, the chamber 34 with the infrared rods descends over the material support. Here also, the goods are in motion and, according to the preestablished time or to the residual humidity, it is completely dried by a hot-air blower. When the drying is concluded, the chamber 34 is raised again, the blower and the heater are turned off and the material carrier with the textile goods travels to the next treatment unit.

FIG. 6 shows a top view of the installation according to FIG. 2.

Figure 7:
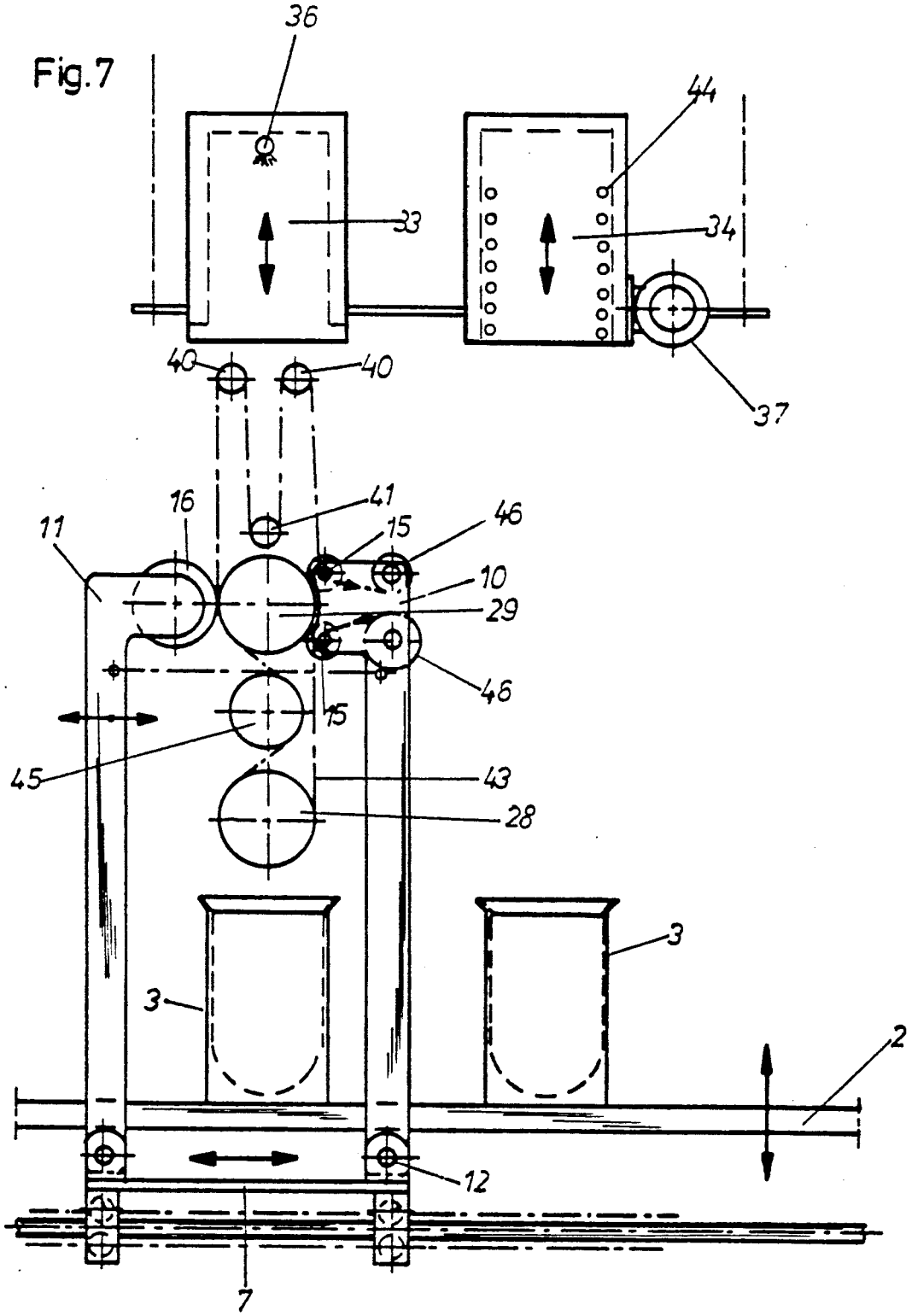
FIG. 7 a schematic longitudinal section of an embodiment of the installation according to the invention with fixed material support, but with raisable and lowerable treatment vats and winding-on devices for the material, for a fully automated process.

In FIG. 7, within the framework of the invention, the treatment vats 3 are designed to be lowered and raised with respect to the material carrier. Here also, instead of the displacement body, a tension control roller 45 is mounted. When longer lengths of material, e.g. more than 8 m need to be dyed, it is advisable to eliminate the endless textile band. Instead the textile goods are wound on fabric rollers 46, which means that the lower fabric roller 6 unwinds and the upper roller winds up, as shown in FIG. 7. The textile goods are marked by dash-dot line 43.

Figure 8:
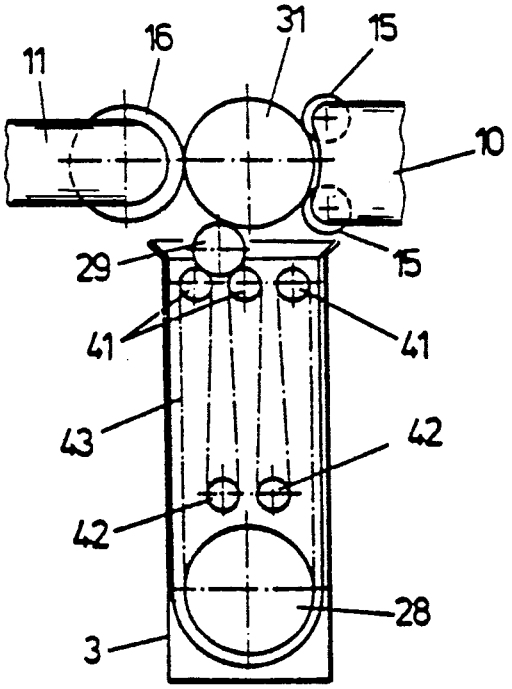
FIG. 8 a schematic representation in cross section of an embodiment of the installation of the invention with a material support capable of carrying a larger amount of material to be dyed in a treatment vat.

FIG. 8 shows a cross section with several freely rotating rollers, which serve to take up endlessly even more textile material (for instance a 8 m piece).

It is self-understood that the above-described technique is limited to a certain roller width or a certain material width. This way, the invention allows the dyeing of goods with the smallest width (test batches) to normal width (150–160 cm) and wide width (320 cm and more) such as used for table and bed linen. Also, it is self-understood that the roller widths and the other technological parameters can be adjusted to a large-scale operation, in order to insure the congruency of the process.

If several treatment baths are required, as usually happens in such processes, the frame 7 travels with raised carrier and lifted chambers 33 and 34 into the next position, and the previously described work scenario starts again. These motion sequences are suitably program-controlled, so that after a starting impulse is triggered, they follow their course automatically.

As previously mentioned, the installation is relatively small, the vats 3 contain only a small amount of treatment liquid but the machine parts acting upon the textile goods still have a size which corresponds to the production installation, so that even in these small test units it is possible to develop the forces which act upon the textile goods during travel through the production installation.

Machine frame 1 according to the embodiment example is additionally movable, so that it can be attached to various test units. Basically, it would be possible to design the bearing surface 2 with the vats 3 movable with respect to the swivel arms 10 and 11. However, this would require a considerably longer construction of the installation, so that this type of support for the parts and of relative movement of the parts is not considered suitable If in the shown embodiment example a drive motor is located on the horizontally slidable frame 7 for the actuation of the pressure roller 16, which acts upon this pressure roller 16 via guide rollers and drive members, it would also be possible to place a drive motor in the roller 16 itself. If in the shown embodiment example the swivel arms 10 and 11 are supported swingably about the low-lying axes 12 and 13, it can also be considered within the framework of the invention to arrange the pressure roller 16 and the thrust rollers 15 on a horizontally movable carriage From FIG. 6 can be seen that the thrust rollers 15 respectively arranged in pairs rest respectively only against the outer edge of the roller 31. If the frame 7 in the shown embodiment example is moved by stationary motor via a cable or chain pull 8, naturally it would also be possible to move the frame 7 by means of a motor mounted on the frame 7 and a fixed tooth rack. The vats 3 are set in the holder 4 and can be lifted out of the holders. Since this vat contains only a small quantity of the respectively required treatment liquid, the weight of these filled vats is relatively small, so that the vats can me manipulated without special auxiliary equipment.

With the installation according to the invention, it is possible to subject small amounts of textile samples such as threads, yarns, strands, woven fabrics or knits to the desired process sequences, namely in conditions corresponding to the ones existing in the industrial production. On the carrier with the rollers 28, 29 and 31, the textile goods are to be moved endlessly in the respective bath; the textile goods can through this way undergo all the treatment stages, much like in a production installation, with the result of these treatments being comparable to results obtained in production installations.

The dimensions of the rollers, the roller diameters, the revolving speed of the material to be treated, the bath ratio, the treatment times and the width of the material, etc. are precisely adjustable to the large-scale installations, and therefore the results of various treatments correspond precisely to practice, and the treatment parameters can be directly transferred (without factors).

An embodiment not shown in the drawing is also conceivable, wherein the carrier has several freely rotatable rollers 40 with basically vertically superpositioned axes, between the upper roller 29 and the lower roller 28, whereby here the goods to be treated run around the roller 29, the roller 28, and then around several rollers 40 and then again around roller 29. With the same rotational speed of rollers 28 and 29 and the same diameter as in the first above-discussed embodiment example, the dwelling time of the material to be treated in the treatment liquid is extended and at the same time the penetration of the dye is intensified. These interposed rollers 40 in this carrier also serve as displacement bodies. Similar considerations apply also to an embodiment of the carrier as shown in FIG. 8. With a correspondingly high level in vat 3, the goods to be treated are dyed without the access of oxygen. For various known dyeing processes this is important. Here, over the lower roller 28 several rollers with a smaller diameter ar arranged in two different horizontal planes, whereby the driving force acts upon at least one of the upper rollers, while the underlying rollers 42 of the lower roller group serve as guide rollers.

Figure 9:
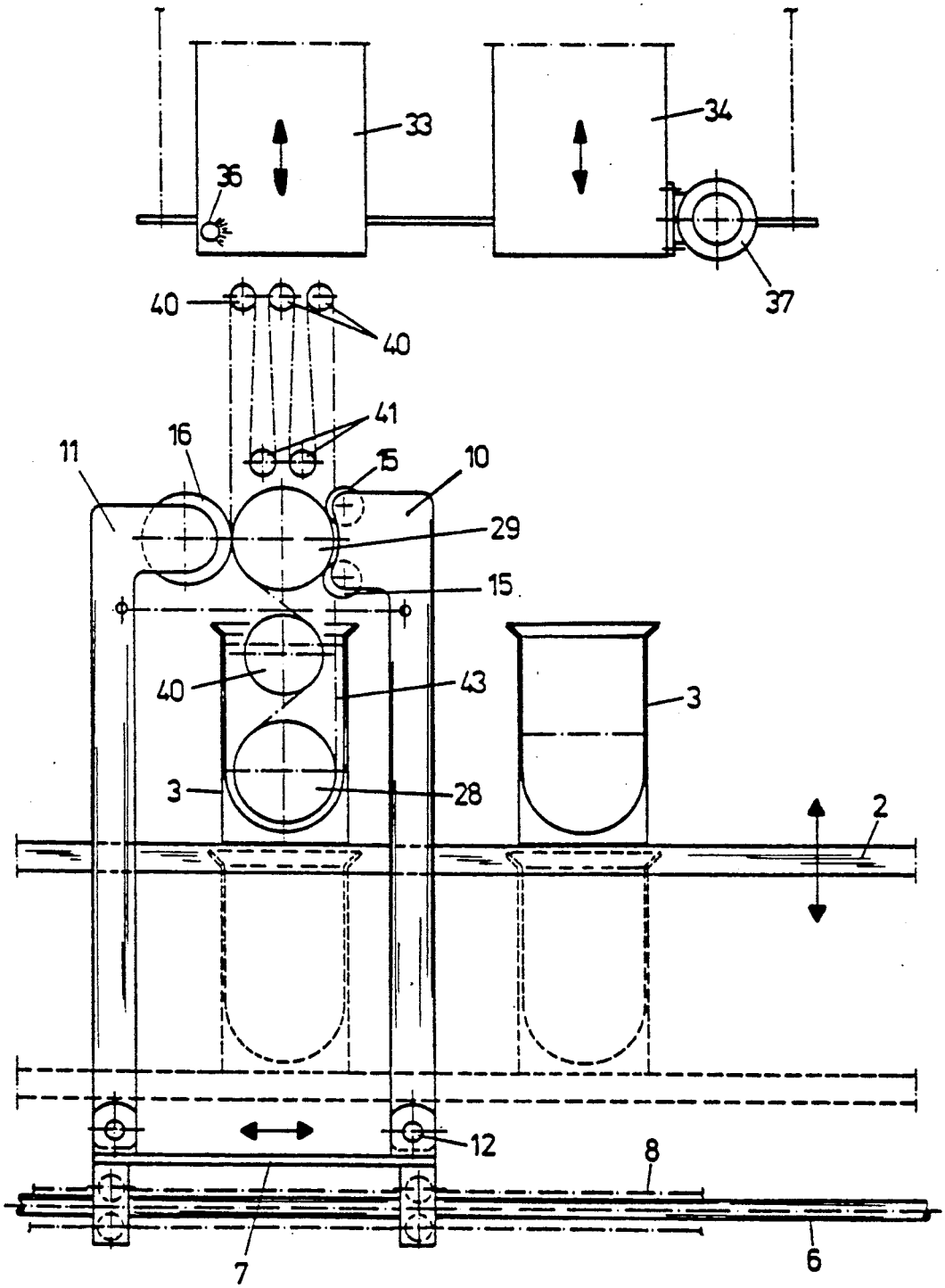
FIG. 9 a schematic representation in longitudinal section of an embodiment of the installation of the invention with fixed material support, but with raisable and lowerable treatment vats for a fully automatized process.

FIG. 9, just like FIG. 7, shows an embodiment with fixed material carrier 28, 29, but with raisable and lowerable treatment vats 3 for a fully automated process, whereby in comparison to FIG. 7, in FIG. 9 the possibility to raise and lower the treatment vats 3 is additionally illustrated in the drawing.

In accordance with the invention, the rollers of the wet treatment installation can be just as large (in length and diameter) as the rollers used in the industrial installations; but still all the parts of the installation are located in a very limited space, particularly a space which can be used also in test conditions, and thereby the forces and tensions arising in the industrial production are reproduced in the installation of the invention.

In order to demonstrate the size proportions of an installation according to the invention it can be mentioned that the machine frame 1 has a length L (FIG. 1) of 2 m and a width of 1 m. For piece material, suitably for a length L of 2 m corresponding to the width of the material at a width of for instance 4 m, a width of 4.20 m will be selected. Thereby, in the case of piece material, the length of the rollers is adjusted to the width of the material, while their diameter lies for instance between 50 and 170 mm, which means particularly the diameter of the rollers 28, 29, 31 and 16 corresponds to the diameter of the rollers used in industrial installations. However, in the case of test units, rollers with a smaller diameter can also be used.

A special advantage of the installation according to the invention—as can be seen from the above description of the embodiment examples—is that the textile goods can be guided as an endless band on the material carrier in each treatment phase (with the rollers 28, 29 and in certain cases 31) and that the textile goods and the material carrier can travel from treatment unit to treatment unit and pass through them. This allows fully automated and preprogrammed treatments in all considered kinds of treatment. According to program, the textile goods and the material carrier can also travel independently from the sequence of the treatment units, to be moved back and forth—according to program—between, respectively under or over these nits, so that the same installation according to the invention can be flexible used for instance for at least more than one of the four treatment kinds described in the introduction of the specification.

We claim:

1. Installation for treating a textile material comprising:

at least one treatment unit; and a carrier for holding said textile material and guiding same as an endlessly rotating band, said carrier being movable towards and away from said treatment unit, said installation further including a frame, a motor-driven roller and at least two superpositioned rollers arranged one on top of the other having basically parallel axes, said at least two superpositioned rollers being supported on said frame, said carrier including at least one upper and one lower roller guiding said textile material, said upper roller being engaged by said motor-driven roller when said carrier is lowered within said treatment unit thereby actuating said two rollers that are one on top of the other.

2. Installation according to claim 1 wherein at least one of said upper and said lower rollers of said carrier supporting said textile material cooperates with another roller on a surface thereof to form a squeezing mechanism.

3. Installation according to claim 1 wherein said upper and lower rollers each have a longitudinal axis, said upper and lower rollers being mutually adjustable for changing relative distance therebetween said axes.

4. Installation according to claim 3 further comprising a displacement body having a thickness smaller than a diameter of said upper and lower rollers and positioned therebetween.

5. Installation according to claim 3 further comprising a plurality of freely rotatable rollers positioned between said upper and lower rollers.

6. Installation according to claim 3 further comprising a plurality of mutually parallel rollers positioned in a plane above said lower roller, at least one of said mutually parallel rollers being driven by said motor-driven roller, a plurality of freely rotatable guide rollers being provided between said upper and lower roller and lying approximately in a horizontal plane, whereby said mutually parallel and freely rotatable rollers have collective diameters thereof being smaller than a diameter of said lower roller.

7. Installation according to claim 1 wherein said upper roller can be slightly inclined with respect to an axis of said lower roller.

8. Installation according to claim 1 wherein said upper and lower rollers are supported at a first and second end of said frame, said frame having vertical sides telescopically designed with at least one external part attached thereto, one of said upper rollers being supported on one of said external parts of said telescopic frame sides.

9. Installation according to claim 8 wherein one of two of said external parts of said telescopic frame side has a segment extended upwardly with respect to the other part, an additional roller being supported on said extended segment, said additional roller being in drive contact with said upper roller taking up said textile material via drive means.

10. Installation according to claim 8 further comprising a lateral bracket with a major axis located in said extended segment of said frame side, said major axis oriented approximately parallel to major axes of said upper, lower and additional rollers, said bracket being height adjustable on a vertical guide.

11. Installation according to claim 10 further comprising a pair of swivel arms movable through respective swivel axes means which erst on a horizontal frame, said motor-driven roller and said two superpositioned rollers being supported on said swivel arms, said vertical guide being mounted on said horizontal frame, and said swivel axes means being provided on respective sides of said vertical guide.

12. Installation according to claim 11 wherein said motor-driven roller is supported at an upper end of one of said swivel arms and two superpositioned rollers are freely rotatable and supported on said other swivel arm.

13. Installation according to claim 12 further comprising at least one piston-cylinder unit positioned between said swivel arms and functioning to swing said arms.

14. Installation according to claim 11 further comprising a support rail pair, said horizontal frame being slidable along a rail of said rail pair, a horizontal bearing surface being arranged above said horizontal frame, at least one treatment unit filled with treatment liquids being supported on said horizontal bearing surface.

15. Installation according to claim 14 further comprising a chamber which is height adjustably arranged relative to at least one of said treatment units, said chamber serving for further treatment of said textile material, said chamber when lowered permitting said carrier for said textile material to be immersed at least along part of said height, said chamber being positionable in a machine frame above said swivel arms, said horizontally displaceable frame, rial pair and bearing surface all being arranged in said machine frame.

16. Installation according to claim 15 wherein diameters of said upper, lower and additional rollers are basically identical.

17. Installation according to claim 1 wherein said textile material held on said carrier can be travelled at least once through a plurality of said treatment units.

18. Installation according to claim 1, wherein there are at least three treatment units, said units having functions selected from the group consisting of washing, dyeing, oxidizing, drying and combinations thereof.

19. Installation according to claim 18 wherein said treatment units include at least three treatment troughs for wet processing of said textile material.

20. Installation according to claim 19 wherein at least one of said troughs for wet processing includes a steaming device and said treatment units include at least one unit for dry processing of said textile material.

21. Installation according to claim 18 wherein said treatment units are arranged in a horizontal row and said carrier being capable of traveling over said row in any desired succession.

22. Installation according to claim 18 wherein said treatment units are arranged in a vertical row one above another and said carrier being capable of travelling over and under said row in any desired succession.

* * * * *